United States Patent [19]

Sueyoshi

[11] Patent Number: 4,711,508

[45] Date of Patent: Dec. 8, 1987

[54] TERMINAL RETAINING STRUCTURE FOR CONNECTOR

[75] Inventor: Tadahiro Sueyoshi, Kosai, Japan

[73] Assignee: Yazaki Corporation, Japan

[21] Appl. No.: 809,069

[22] Filed: Dec. 13, 1985

[30] Foreign Application Priority Data

Dec. 14, 1984 [JP] Japan ..... 59-188819[U]

[51] Int. Cl.[4] ..... H01R 11/00

[52] U.S. Cl. ..... 439/595; 439/603

[58] Field of Search ..... 339/59 R, 59 M, 97 R, 339/97 C, 97 P

[56] References Cited

U.S. PATENT DOCUMENTS

| | | | |
|---|---|---|---|
| 4,114,971 | 9/1978 | Heimbrock | 339/59 R |
| 4,253,718 | 3/1981 | Bungo | 339/59 R |
| 4,295,698 | 10/1981 | Chow | 339/59 R |
| 4,348,070 | 9/1982 | Simon | 339/59 R |

*Primary Examiner*—Gil Weidenfeld

*Assistant Examiner*—Paula A. Austin

*Attorney, Agent, or Firm*—Lowe, Price, LeBlanc, Becker & Shur

[57] ABSTRACT

A terminal retaining structure for a connector, having a terminal locking tongue formed integrally with the connector housing so as to extend at an angle to the upper surface of the connector housing and to be bent flat over the upper surface of the connector housing for retaining a terminal inserted in the terminal chamber of the connector housing, and provided with a hook or hooks corresponding to the terminal chamber or terminal chambers, respectively. When the locking tongue is bent flat over and locked to the upper suface of the connector housing with a catch, the hook engages the shoulder of the terminal inserted in the terminal chamber and pushes the latter inward to the correct position and retains the terminal firmly at the correct position. The terminal retaining structure is applicable to both a single connector or a multiple connector.

6 Claims, 5 Drawing Figures

TERMINAL RETAINING STRUCTURE FOR CONNECTOR

BACKGROUND OF THE INVENTION

The present invention relates to improvements in a terminal retaining structure for a connector having terminals retained within the terminal chambers of a connector housing.

A sufficient strength of terminal retaining members and incomplete insertion of terminals in the connector chambers in assembling a connector are factors in the causation of the terminals coming out of the connector housing of a connector.

A structure, as illustrated in FIG. 4, capable of preventing the incomplete insertion of terminals has been proposed. This structure prevents the incomplete insertion of terminals, not shown and the untimely separation of the terminals from the connector housing by inserting a plate-shaped spacer f having terminal retaining sections d and catching section e into a spacer chamber c formed in the upper section of the interior of the terminal chambers b of a connector housing a so that the catching parts e and a projection g lock.

Such a structure, however, comprises two separate parts, namely, the connector housing and the spacer, and hence the manufacturing cost increases and it is possible that the insertion of the spacer in the connector housing is forgotten. Furthermore, when this structure is applied to a multiple connector having a plurality of terminals chambers as shown in FIG. 4, it is necessary to insert the spacer into the connector housing against a high resistance avoiding entanglement with a plurality of wires, which adversely affects to working efficiency.

SUMMARY OF THE INVENTION

Accordingly, it is an object of the present invention to solve the above-mentioned problems of the conventional connector and to provide a connector of a structure having a terminal locking tongue formed integrally with a connector housing. This structure eliminates faulty work such as forgetting the insertion of the spacer, simplifies the connector assembling work even if the connector is a multiple connector, and surely retains the terminals.

The above and other objects, features and advantages of the present invention will become more apparent from the following description of a preferred embodiment thereof taken in conjunction with the accompanying drawings.

DESCRIPTION OF THE PREFERRED EMBODIMENT

Figure 1:
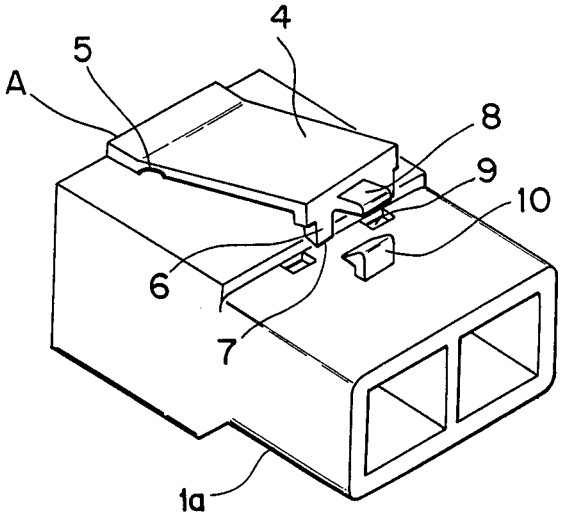
FIG. 1 is a perspective view of a terminal retaining structure in a preferred embodiment, according to the present invention.
Figure 2:
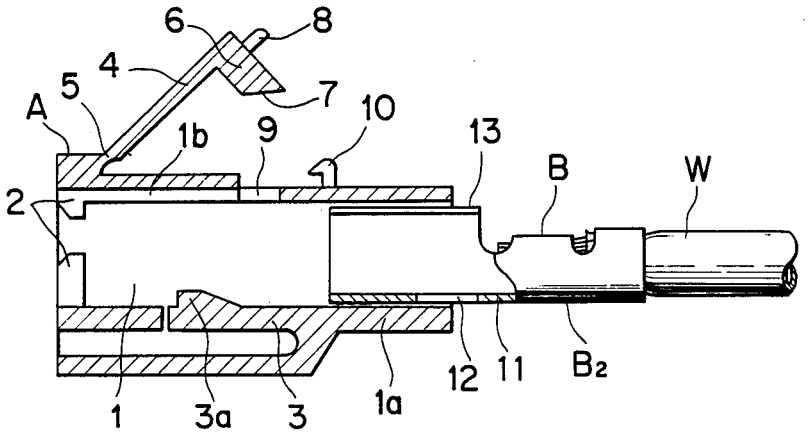
FIG. 2 is a longitudinal sectional view of the structure of FIG. 1.

Referring to FIGS. 1 and 2, a connector housing A has a plurality of terminal chambers 1, and a socket terminal B. Front stop walls 2 for limiting the depth of insertion of the socket terminals B are formed in the open front ends of the terminal chambers 1, respectively. Flexible fingers 3 each having a catching protrusion(s) 3*a* which engage a hole 12 formed in the base plate 11 of the socket terminal B are formed in the bottom walls 1a of the terminal chambers 1, respectively. This constitution is the same as that of the conventional connector. However, according to the present invention, a swingable locking tongue 4 is provided, in addition to the above-mentioned structure, so as to engage the socket terminal B inserted in each terminal chamber 1.

The locking tongue 4 extends rearward from the front end of the upper surface of the connector housing A with the front end thereof integrally hinged to the front end of the upper wall of the connector housing A by a hinge 5. Hooks 6 for retaining the socket terminals B extend downward from the rear end of the locking tongue 4. The front face of the hook 6 is inclined to form a wedge 7 for ensuring the complete insertion of the socket terminal B, while a locking lug 8 is formed in the rear face of the hook 6.

Openings 9 for receiving the hooks 6 therethrough are formed in the upper walls the connector housing A, more specifically, in the upper walls 1b of the terminal chambers 1, respectively. A catch 10 which engages the locking lug 8 is formed in the upper surface of the upper wall of the connector housing A.

The manner of connecting the socket terminal B to the connector housing A will be described hereinafter.

The socket terminal B connected to the free end of a wire is inserted into the terminal chamber 1 through the rear opening of the same with the locking tongue 4 of the connector housing A raised as illustrated in FIG. 1. The socket terminal B is inserted in the terminal chamber 1 as far as the front end of the socket contact $B_1$ thereof rests against the front stop wall 3*a* and the catching protrusion 3*a* of the flexible finger 3 drops into the hole 12 of the base plate 11 of the socket terminal B as illustrated in FIG. 3*b*. Thus, the socket terminal B is more or less surely retained in the terminal chamber 1.

Figure 3A:
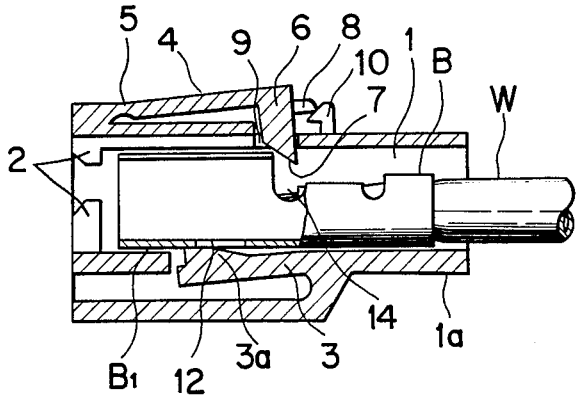
FIG. 3*a* and 3*b* are longitudinal sectional views, similar to FIG. 2, of assistance in explaining the function of the terminal retaining structure of FIG. 1.
Figure 3B:
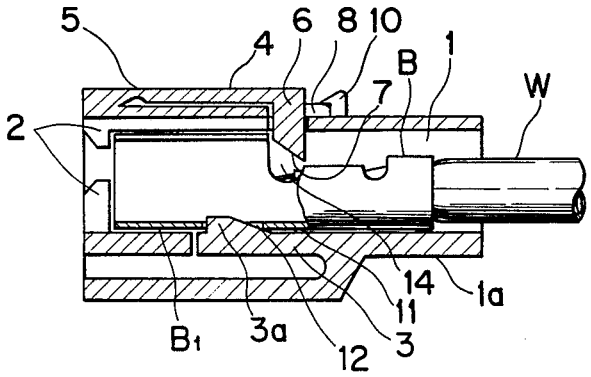
Figure 4:
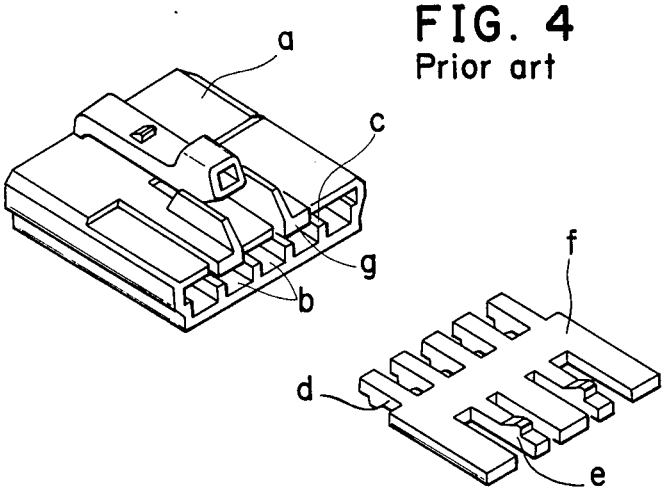
FIG. 4 Prior art
FIG. 4 is a perspective view of a conventional connector.

Even when the socket terminal B is not inserted deep enough into the terminal chamber 1 as illustrated in FIG. 3*a*, closing the locking tongue 4 to depress the same through the opening 9 into the terminal chamber 1 causes the wedge 7 of the hook 6 engage the rear shoulder 13 of the socket contact $B_1$ of the socket terminal B, so that the socket terminal B is pushed forward by the wedge 7 to a correct position, and thereby the socket terminal B is completely inserted in the terminal chamber 1 as illustrated in FIG. 3*b*. At the same moment, the hook 6 of the locking tongue 4 drops fully into a space 14 between the socket contact $B_1$ and the wire connecting part $B_2$ of the socket terminal B, and the locking lug 8 engages the catch 10 to lock the locking tongue 4 in place. Consequently, retention of the socket terminal B is ensured doubly by the flexible finger 3 and the locking tongue 4 against a rearward pulling force that may act on the same.

The locking tongue 4 can be depressed simply without being bothered with the wire W connected to the socket terminal B.

In this embodiment, locking tongue 4 is provided individually for each terminal chamber. However, it is possible to provide a single locking tongue for two to ten terminal chambers arranged laterally side by side. When a connector is provided with such a locking tongue, a lateral slot is formed in the upper wall of the connector housing, instead of the openings 9.

The same effect is obtained also when the locking tongue 4 is extended forward from the rear end of the connector housing A. In this case, the catch 10 is provided in front of the openings 9.

As is apparent from the foregoing description, according to the present invention, the terminals can be inserted surely and correctly in the terminal chambers and the terminals are retained firmly in place simply by depressing the locking tongue or locking tongues. Furthmore, since the locking tongue or locking tongues are formed integrally with the connector housing, faulty assembling work, such as forgetting the insertion of the spacer, which is liable to occur in assembling the conventional connector, is prevented and the manufacturing cost can be reduced. Still further, the terminals can be locked simply by depressing the locking tongue or locking tongues without being bothered by the wires connected to the terminals.

Although the invention has been described in its preferred form with a certain degree of particularity, it is to be understood that various changes and variations in the invention are possible without departing from the spirit and scope thereof.

What is claimed is:

1. A terminal retaining connector structure for retaining an electrical terminal contact having a front end terminating in a rear shoulder comprising:

a connector housing having first and second peripheral walls, said first and second walls defining terminal receiving space means, said first wall having an opening means to open into said terminal receiving space means for receiving the front end of the terminal; and a swingable locking tongue having a forward hinge portion and a rear free end, said tongue formed integrally with said first wall to extend rearwardly from said hinge portion at an angle to said first wall and being pivotal through said angle about the hinge portion towards said first wall so as to be juxtaposed and generally parallel with respect thereto when in a locking position, said swingable tongue having a wedge-shaped hook formed in said free end, said wedge-shaped hook having sloping surface facing forwardly, said wedge-shaped hook adapted to be inserted through said opening into said terminal receiving space means when said swingable locking tongue is bent flat over the first wall into the locking position wherein the sloping surface engages the rear shoulder so that the terminal is pushed forwardly into the connector housing by the sloping surface exerting a forwardly directed force on the rear shoulder as the tongue is bent to locking position.

2. A terminal retaining structure according to claim 1, wherein said terminal receiving space means includes a plurality of chambers each having a rearward terminal inlet, said opening means including a plurality of openings formed to open into said respective plurality of chambers.

3. A terminal retaining structure according to claim 1, further including latch means integrally formed in selected one of the first and second peripheral walls for latching the terminal when said terminal is completely inserted in the terminal receiving space means, said sloping surface being upwardly inclined towards the hinge portion and pressing the terminal forwardly to ensure latching if said insertion is incomplete.

4. A terminal retaining structure according to claim 3, wherein said first and second peripheral walls are opposite to each other.

5. A terminal retaining structure according to claim 1, wherein said swingable locking tongue and said first peripheral wall having catch means.

6. A terminal retaining structure according to claim 5, wherein said catch means includes a locking lug formed on the swingable locking tongue and a catch formed on the first peripheral wall.

* * * * *